US011009241B2

(12) United States Patent
Nagashima et al.

(10) Patent No.: US 11,009,241 B2
(45) Date of Patent: May 18, 2021

(54) HEAT SOURCE UNIT FOR REFRIGERATION APPARATUS

(71) Applicant: DAIKIN INDUSTRIES, LTD., Osaka (JP)

(72) Inventors: Toshihiro Nagashima, Osaka (JP); Naoto Horiuchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/497,247

(22) PCT Filed: Mar. 5, 2018

(86) PCT No.: PCT/JP2018/008345
§ 371 (c)(1),
(2) Date: Sep. 24, 2019

(87) PCT Pub. No.: WO2018/180246
PCT Pub. Date: Oct. 4, 2018

(65) Prior Publication Data

US 2020/0378627 A1 Dec. 3, 2020

(30) Foreign Application Priority Data

Mar. 30, 2017 (JP) ..... JP2017-066910

(51) Int. Cl.
*F24F 1/36* (2011.01)
*F25B 49/02* (2006.01)
(Continued)

(52) U.S. Cl.
CPC ..... *F24F 1/36* (2013.01); *F25B 49/02* (2013.01); *F24F 13/20* (2013.01); *F25B 13/00* (2013.01); *F25B 2400/06* (2013.01)

(58) Field of Classification Search
CPC ..... F24F 1/36
(Continued)

(56) References Cited

U.S. PATENT DOCUMENTS 7,430,877 B2 * 10/2008 Davenport ..... F24F 13/224 62/272
7,878,019 B2 * 2/2011 Cantolino ..... F24F 13/222 62/285
(Continued)

FOREIGN PATENT DOCUMENTS

CN 103134257 A 6/2013
CN 205048854 U 2/2016
(Continued)

OTHER PUBLICATIONS

International Search Report (PCT/ISA/210) issued in PCT/JP2018/008345, dated Apr. 17, 2018.
(Continued)

*Primary Examiner* — Filip Zec
(74) *Attorney, Agent, or Firm* — Birch, Stewart, Kolasch & Birch, LLP

(57) ABSTRACT

A chiller unit, which is a heat source unit, includes devices, such as a compressor and an electric component box in a machine chamber in a lower portion thereof, and a heat exchanger in an air passage in an upper portion thereof. A drain pan is disposed under the heat exchanger, and a drain gutter is disposed under the outflow port of the drain pan. The drain gutter includes a main drain port at its end portion where the depth of the drain gutter is deepest, and a secondary drain port at its end portion where the depth of the drain gutter is shallowest. The drain gutter has a guide portion, the end of which protrudes to the outside of the casing.

6 Claims, 11 Drawing Sheets

(51) Int. Cl.
*F24F 13/20* (2006.01)
*F25B 13/00* (2006.01)

(58) Field of Classification Search
USPC ..... 62/285–291
See application file for complete search history.

(56) References Cited

U.S. PATENT DOCUMENTS

| | | | | |
|---|---|---|---|---|
| 10,514,196 | B2 * | 12/2019 | Long | F24D 19/08 |
| 10,830,490 | B2 * | 11/2020 | Rokade | F24F 13/222 |
| 2009/0038328 | A1 * | 2/2009 | Piccione | F24F 13/222 62/291 |
| 2011/0179818 | A1 * | 7/2011 | Hast | F25D 21/14 62/290 |
| 2012/0125033 | A1 | 5/2012 | Tanno et al. | |
| 2013/0312432 | A1 * | 11/2013 | Hodges | B64D 13/06 62/56 |
| 2013/0333409 | A1 | 12/2013 | Tanno et al. | |
| 2015/0089969 | A1 * | 4/2015 | Nakamura | F25D 21/14 62/285 |
| 2016/0123651 | A1 * | 5/2016 | Barbely | F24F 13/222 62/291 |

FOREIGN PATENT DOCUMENTS

| | | | |
|---|---|---|---|
| JP | 59-56065 | A | 3/1984 |
| JP | 59-143279 | U | 9/1984 |
| JP | 5-89660 | U | 12/1993 |
| JP | 2010-261622 | A | 11/2010 |
| TW | 557348 | B | 10/2003 |
| WO | WO 2011/013672 | A1 | 2/2011 |

OTHER PUBLICATIONS

Extended European Search Report for European Application No. 16776355.2, dated Dec. 11, 2020.

* cited by examiner

HEAT SOURCE UNIT FOR REFRIGERATION APPARATUS

TECHNICAL FIELD

The present invention relates to a heat source unit for a refrigeration apparatus.

BACKGROUND ART

Patent Document 1 discloses a heat source unit for a refrigeration apparatus. The heat source unit includes devices, such as a compressor and an electric component box, at a lower portion thereof, and a heat exchanger and a fan at an upper portion thereof. A drain pan is disposed under the heat exchanger. In the heat exchanger serving as an evaporator, water vapor in the air is condensed. Condensed water generated in the heat exchanger flows down to the drain pan and is collected, and is drained to the outside of the heat source unit through a hose or the like connected to the drain port of the drain pan. Further, in rainy weather, rain falls down to the upper portion of the heat source unit where the heat exchanger is disposed. Rainwater which has fallen down to the heat source unit flows down to the drain pan and is collected, and is drained to the outside of the heat source unit like the drain water.

CITATION LIST

Patent Document

Patent Document 1: WO 2011/013672

SUMMARY OF THE INVENTION

Technical Problem

A relatively large foreign substance, such as fallen leaves, may enter the heat source unit. When such a foreign substance enters a hose or the like connected to the drain pan, there is a possibility that the hose is clogged and the water cannot be discharged from the drain pan. If water cannot be drained from the drain pan, water overflows from the drain pan, and devices such as a compressor disposed under the heat exchanger and an electric component housed in the electric component box get wet, which may lead to failure of these devices.

In view of the foregoing background, it is therefore an object of the present invention to prevent failure of a device caused by the water overflow from the drain pan, and improve the reliability of the heat source unit.

Solution to the Problem

A first aspect of the present disclosure is directed to a heat source unit for a refrigeration apparatus. The heat source unit includes: a compressor (11); a heat exchanger (21, 22) which allows a refrigerant to exchange heat with air; a fan (25); an electric component box (15) for housing an electric component; and a casing (30) for housing the compressor (11), the heat exchanger (21, 22), the fan (25), and the electric component box (15). A lower portion of the casing (30) is a closed space separated from an outside, and constitutes a machine chamber (31A to 31D) in which the compressor (11) and the electric component box (15) are housed. An upper portion of the casing (30) is provided with the heat exchanger (21, 22) and the fan (25), and constitutes an air passage (32A to 32D) through which air flows. The heat source unit includes: a drain pan (60) disposed under the heat exchanger (21, 22) and receives condensed water generated in the heat exchanger (21, 22); and a drain gutter (70) which is disposed under an outflow port (62) that is open in a bottom plate (61) of the drain pan (60), and which receives water that has passed through the outflow port (62). The drain gutter (70) has a depth which gradually increases from one end to the other end of the drain gutter (70). A main drain port (81) is formed at an end portion of the drain gutter (70) where the depth of the drain glitter (70) is deepest, and the main drain port (81) is intended to drain water in the drain gutter (70) to an outside of the machine chamber (31A to 31D). A secondary drain port (83) is formed at an end portion of the drain gutter (70) where the depth of the drain gutter (70) is shallowest, and the secondary drain port (83) being intended to drain water in the drain gutter (70) to the outside of the machine chamber (31A to 31D).

In the heat source unit (1) of the first aspect, the drain pan (60) is disposed under the heat exchanger (21, 22) disposed in the air passage (32A to 32D). The condensed water generated in the heat exchanger (21, 22), the rainwater that has entered the air passage (32A to 32D), or the like, fall down to the drain pan (60). The water in the drain pan (60) flows into the drain glitter (70) through the outflow ports (62). The water that has flowed into the drain gutter (70) flows toward the end portion where the depth of the drain gutter (70) is deepest, and flows out of the machine chamber (31A to 31D) through the main drain port (81).

A relatively large foreign substance, such as fallen leaves, may enter the air passage (32A to 32D) of the heat source unit (1). When such a relatively large foreign substance flows into the drain gutter (70) from the drain pan (60) together with water, the main drain port (81), the drain hose connected to the main drain port (81), or the like may be clogged. If the water cannot be drained from the main drain port (81), the water is accumulated in the drain gutter (70). Further, when a large amount of rainwater is fallen into the air passages (32A to 32D) of the heat source unit (1) in a short period of time due to localized heavy rain or the like, the amount of water flowing into the drain gutter (70) may exceed the amount of water flowing out of the main drain port (81) even without the clogging of the main drain port (81) and the drain hose. Water is accumulated in the drain gutter (70) in this case, as well.

To address this situation, in the first aspect, the secondary drain port (83) is formed at the end portion where the depth of the drain gutter (70) is shallowest. Once the water is accumulated in the drain gutter (70) and the water level reaches the secondary drain port (83), the water in the drain gutter (70) starts being drained to the outside of the machine chambers (31A to 31D) from the secondary drain port (83). That is, even in a situation in which a sufficient amount of water cannot be drained from the main drain port (81), the water is drained to the outside of the machine chambers (31A to 31D) from the secondary drain port (83), which prevents the water from overflowing from the drain gutter (70). Since the water does not overflow from the drain gutter (70), the water does not enter the machine chambers (31A to 31D), and hence does not fall down to the compressor (11) nor to the electric component box (15).

A second aspect of the present disclosure is an embodiment of the first aspect. In the second aspect, the main drain port (81) and the secondary drain port (83) are formed in side plates of the drain gutter (70), and a lowermost portion of the secondary drain port (83) is lower in position than an uppermost portion of the main drain port (81).

According to the second aspect, the water is drained from the secondary drain port (83) before the water surface in the drain gutter (70) reaches the uppermost portion of the main drain port (81). Thus, the overflow of water from the drain gutter (70) is reliably avoided.

A third aspect of the present disclosure is an embodiment of the first aspect. In the third aspect, the secondary drain port (83) is formed in a side plate of the drain gutter (70), and the drain gutter (70) includes a guide portion (84) which protrudes outward from the side plate of the drain gutter (70) and which extends from a periphery of the secondary drain port (83) to the outside of the casing (30).

According to the third aspect, the guide portion (84) protrudes from the side plate of the drain gutter (70). The water which has flowed out of the secondary drain port (83) is guided to the outside of the casing (30) by the guide portion (84), and is drained from the end of the guide portion (84).

A fourth aspect of the present disclosure is an embodiment of the third aspect. In the fourth aspect, the guide portion (84) constitutes a groove-like drain passage (85), an upper side of which is open.

According to the fourth aspect, the drain passage (85) is comprised of the guide portion (84), and the upper side of the drain passage (85) is open. This configuration substantially prevents the drain passage (85) from being clogged with a foreign substance even when a relatively large foreign substance flows into the drain passage (85) together with water.

A fifth aspect of the present disclosure is an embodiment of the third or fourth aspect of the present disclosure. In the fifth aspect, the casing (30) is provided with a cover member (44) which covers upper, front, and lateral sides of a protruding portion of the guide portion (84) which protrudes to the outside of the casing (30).

According to the fifth aspect, the upper, front, and lateral sides of a protruding portion of the guide portion (84) which protrudes to the outside of the casing (30) are covered with the cover member (44). Rainwater and wind are blocked by the cover member (44). Thus, rainwater and wind hardly enters the inside of the drain gutter (70) from the secondary drain port (83). Further, the lower side of the protruding portion of the guide portion (84) which protrudes to the outside of the casing (30) is not covered with the cover member (44). This configuration allows the water drained from the end of the guide portion (84) to flow down without being blocked by the cover member (44).

A sixth aspect of the present disclosure is an embodiment of any one of the first to fifth aspects. In the sixth aspect, a lower portion of the casing (30) is provided with a maintenance opening (42) capable of being opened and closed so as to remove the compressor (11) from the machine chamber (31A to 31D), and the drain gutter (70) is disposed along a side surface of the casing (30) which is opposite to a side surface of the casing (30) where the maintenance opening (42) is formed.

The drain gutter (70) is disposed under the drain pan (60). In the casing (30), the machine chamber (31A to 31D) is positioned under the drain pan (60). Thus, if the drain gutter (70) is positioned near the maintenance opening (42), the drain gutter (70) may constitute an obstacle in maintenance work for the devices arranged behind the drain gutter (70) in the machine chambers (31A to 31D) and in the work of taking out such devices through the maintenance opening (42).

To avoid this situation, in the sixth aspect, the drain gutter (70) is disposed along a side surface of the casing (30) which is opposite to a side surface of the casing (30) where the maintenance opening (42) is formed. Thus, the drain gutter (70) does not constitute an obstacle in maintenance work for the devices arranged in the machine chambers (31A to 31D) and in the work of taking out the devices through the maintenance opening (42).

Advantages of the Invention

The first aspect provides the drain gutter (70) which receives water flowing out from the outflow ports (62) of the drain pans (60), and the drain gutter (70) is provided with the main drain port (81) at its end portion where the depth of the drain gutter (70) is deepest, and the secondary drain port (83) at its end portion where the depth of the drain gutter (70) is shallowest. In this manner, even in a situation in which a sufficient amount of water cannot flow out from the main drain port (81), the water in the drain gutter (70) can be drained to the outside of the machine chambers (31A to 31D) from the secondary drain port (83), which prevents the water from overflowing from the drain gutter (70). This aspect therefore prevents failure of the compressor (11) and the electric components housed in the electric component box (15) caused by the water overflowing from the drain gutter (70), which can improve the reliability of the heat source unit (1).

In the second aspect, a lowermost portion of the secondary drain port (83) is lower in position than an uppermost portion of the main drain port (81). Thus, water is drained from the secondary drain port (83) before the water surface in the drain gutter (70) reaches the uppermost portion of the main drain port (81). This aspect therefore reliably prevents the overflow of water from the drain gutter (70).

The third aspect allows the water which has flowed out of the secondary drain port (83) to be reliably guided to the outside of the casing (30) through the guide portion (84) provided for the drain gutter (70), thereby making it possible to reliably prevent the water from entering the machine chamber (31A to 31D).

In the fourth aspect, the drain passage (85) is comprised of the guide portion (84), and the upper side of the drain passage (85) is open. The drain passage (85) is therefore hardly clogged with a foreign substance. This configuration of the present aspect contributes to reliably draining water flowing from the secondary drain port (83) to the outside of the casing (30) even if a foreign substance enters the drain passage (85).

In the fifth aspect, the cover member (44) provided for the casing (30) covers the upper, front, and lateral sides of the protruding portion of the guide portion (84) which protrudes to the outside of the casing (30). This configuration allows the water, which has flowed out from the secondary drain port (83), to be reliably drained to the outside of the casing (30) through the guide portion (84), and prevents rainwater and wind from entering the inside of the drain gutter (70) from the secondary drain port (83).

In the sixth aspect, the drain gutter (70) is disposed along a side surface of the casing (30) which is opposite to a side surface of the casing (30) where the maintenance opening (42) is formed. Thus, the drain gutter (70) can be installed under the drain pans (60) without a decrease in workability in maintenance work for the devices arranged in the machine chambers (31A to 31D) and in the work of taking out the devices through the maintenance opening (42).

DESCRIPTION OF EMBODIMENTS

Embodiments of the present invention will be described in detail with reference to the drawings. Note that the following embodiments and variations are merely beneficial examples in nature, and are not intended to limit the scope, applications, or use of the invention.

The chiller unit (1) of this embodiment constitutes a heat source unit of an air conditioner which is a refrigeration apparatus. The chiller unit (1) has a refrigerant circuit in which a refrigerant is circulated to perform a refrigeration cycle, and is configured to cool or heat heat medium water by the refrigerant. The heat medium water cooled or heated in the chiller unit (1) is supplied to a fan coil unit (not shown) and is used to cool or heat the indoor space.

Now, a detailed structure of the chiller unit (1) will be described. Note that the terms in the following description which indicate directions, such as "front," "rear," "right," "left," "upper," "top," "lower," and "bottom" refer to the directions shown in FIG. 1 unless otherwise specified.

Figure 1:
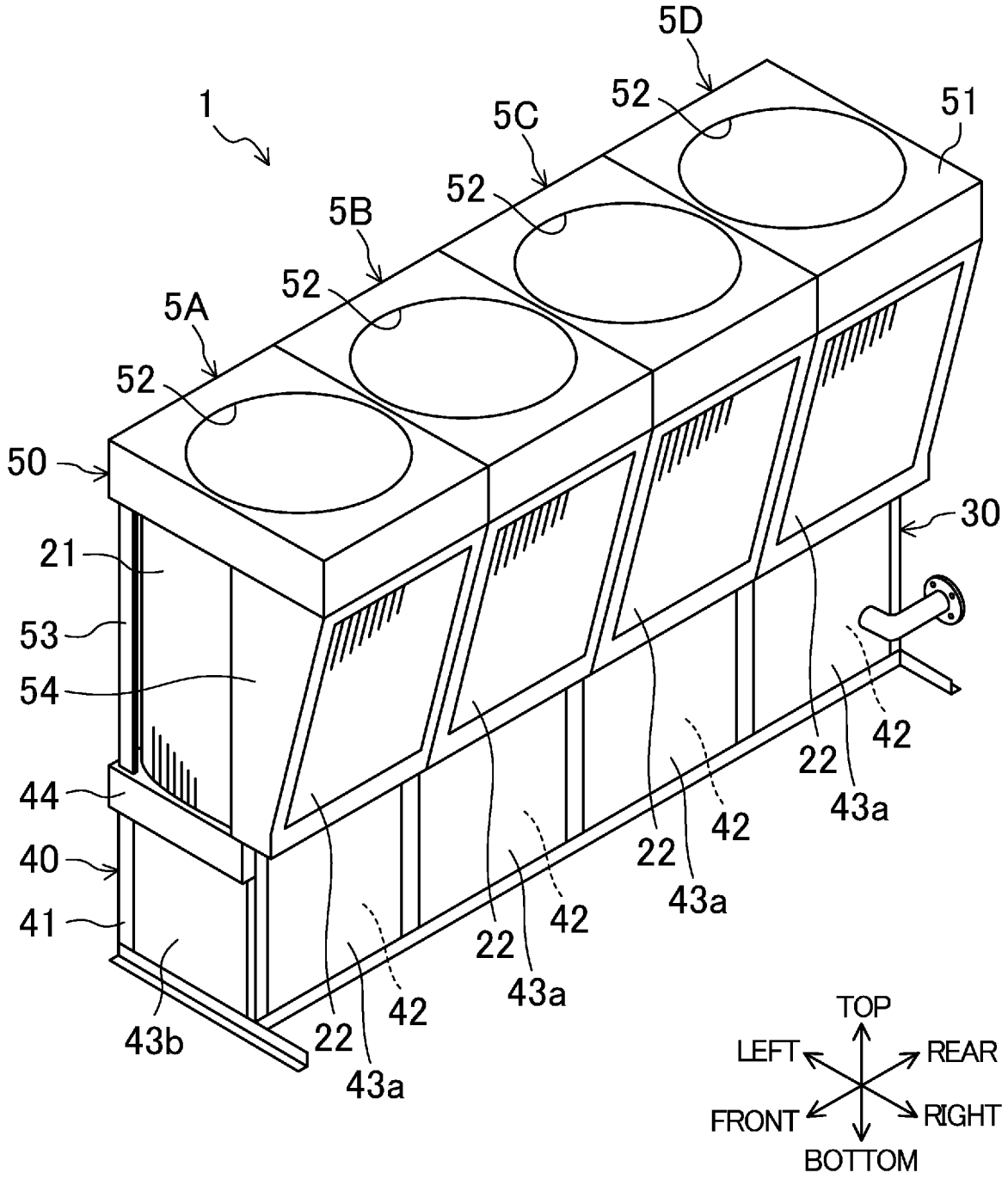
FIG. 1 is a diagram illustrating a perspective view of an entire chiller unit, showing the front and right sides of the chiller unit.
Figure 2:
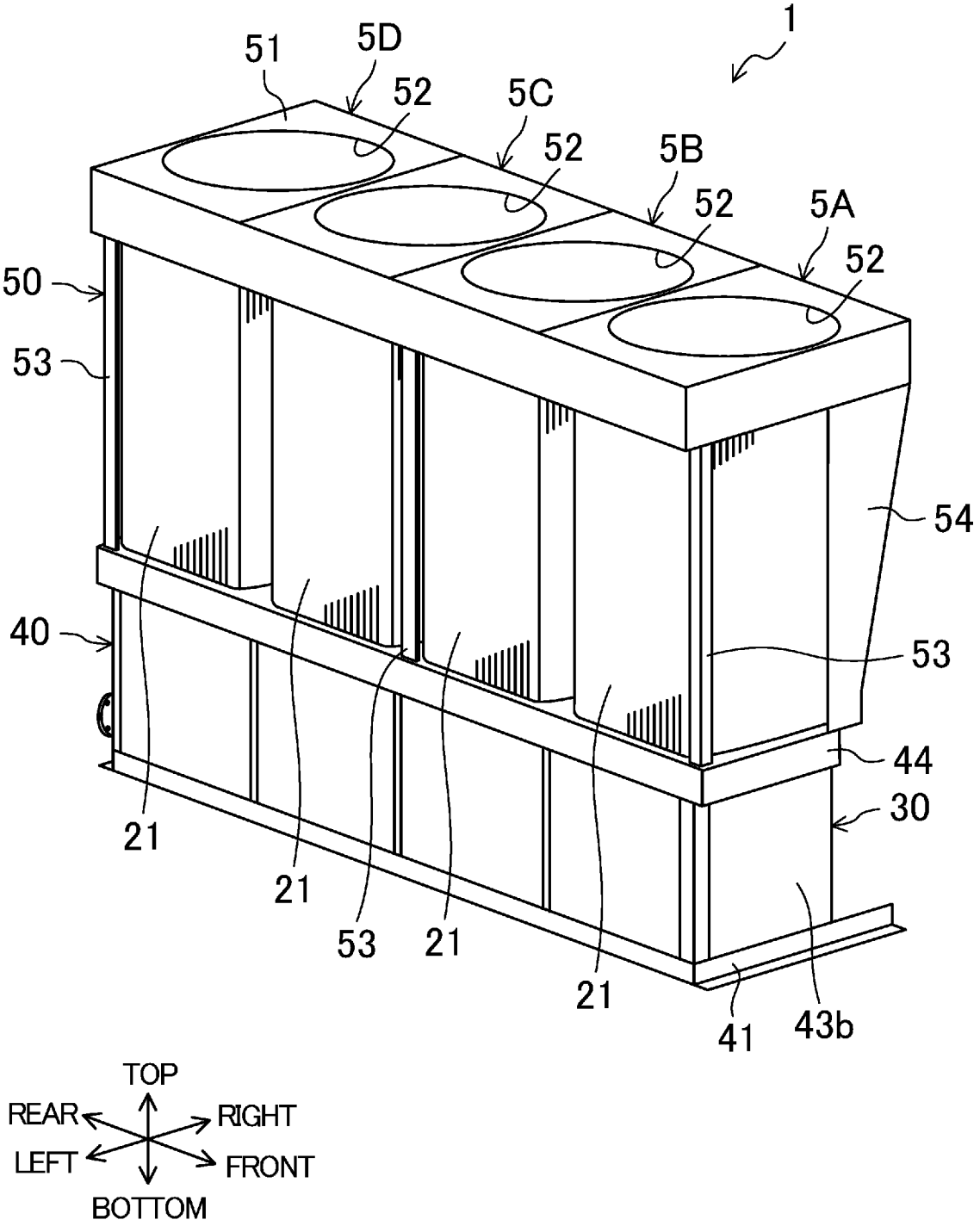
FIG. 2 is a diagram illustrating a perspective view of the entire chiller unit, showing the front and left sides of the chiller unit.

As shown in FIGS. 1 and 2, the chiller unit (1) is long in the front-rear direction. The chiller unit (1) is divided into four subunits (5A, 5B, 5C, and 5D). In the chiller unit (1), the first subunit (5A), the second subunit (5B), the third subunit (5C), and the fourth subunit (5D) are sequentially aligned from the front side to the rear side of the chiller unit (1). As will be described in detail later, the four subunits (5A to 5D) each include a compressor (11), a system electric component box (15), a first air heat exchanger (21), a second air heat exchanger (22), and a fan (25).

Casing

As shown in FIGS. 1 and 2, the chiller unit (1) has a casing (30) which is long in the front-rear direction. The casing (30) is provided with a lower casing (40) and an upper casing (50) arranged above the lower casing (40).

The lower casing (40) is formed in a rectangular parallelepiped shape that is long in the front-rear direction. The lower casing (40) is provided with one support frame (41) and a plurality of side panels. The support frame (41) is a frame in a rectangular parallelepiped shape, and is long in the front-rear direction. The side panels are provided on the front, rear, right, and left side surfaces of the support frame (41) so as to cover each side surface of the support frame (41). The internal space of the lower casing (40) constitutes mechanical chambers (31A, 31B, 31C, and 31D) of the subunits (5A, 5B, 5C, and 5D).

In the lower casing (40), four side panels (43*a*) corresponding to the respective subunits (5A to 5D) are detachably attached to the right side surface of the support frame (41). The right side surface of the support frame (41) serves as a maintenance opening (42) covered with the side panels (43*a*) which is detachable from, and attachable to, the support frame (41). In other words, the four maintenance openings (42) corresponding to the respective subunits (5A to 5D) are formed on the right side surface of the lower casing (40).

Figure 3:
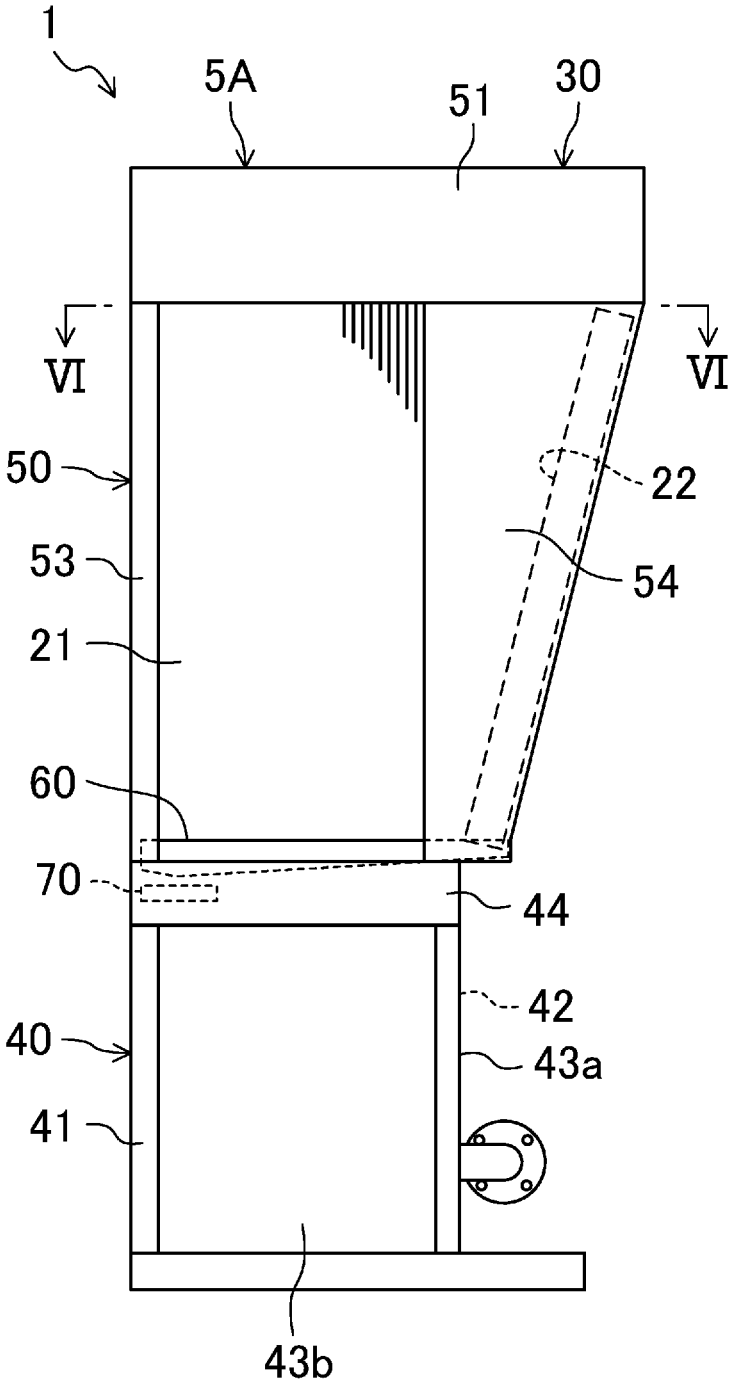
FIG. 3 is a diagram illustrating a front view of the chiller unit.

The upper casing (50) is in a box-like shape that is long in the front-rear direction. As shown in FIG. 3, the upper casing (50) has a pentagonal shape, when viewed from the front, in which the upper portion protrudes toward the right side of the casing. The upper casing (50) constitutes air passages (32A, 32B, 32C, and 32D) of the respective subunits (5A, 5B, 5C, and 5D).

Figure 4:
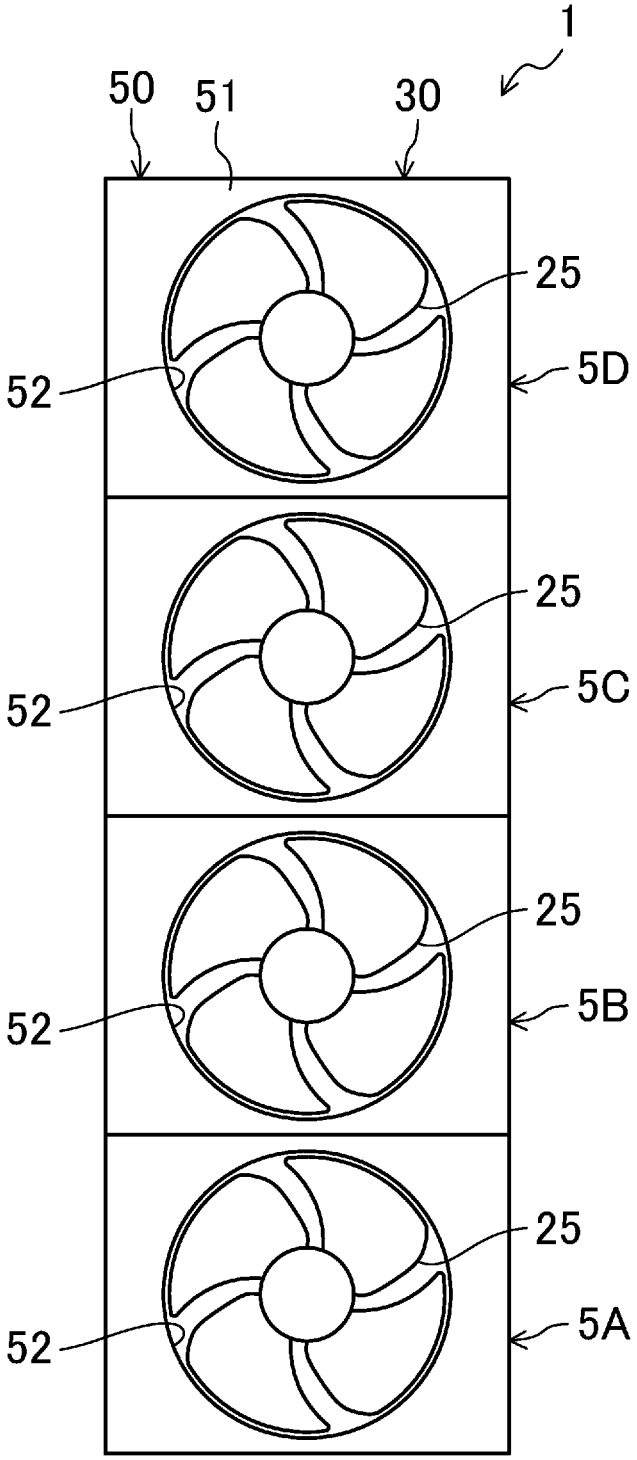
FIG. 4 is a diagram illustrating a plan view of the chiller unit.

The upper casing (50) includes a fan housing (51), support columns (53), shielding plates (54, 55, and 56), and drain pans (60). The fan housing (51) is in a flat rectangular parallelepiped shape, and is disposed on the top of the upper casing (50). As shown in FIG. 4, four circular blowout openings (52) are formed in a top panel of the fan housing (51), and are aligned in the front-rear direction. A fan (25) of each of the subunits (5A to 5D) is disposed in associated one of the blowout openings (52). The support columns (53) are disposed between the fan housing (51) and the lower casing (40) to support the fan housing (51). The drain pans (60) are disposed at the bottom of the upper casing (50), and separate the machine chambers (31A to 31D) and the air passages (32A to 32D) of the respective subunits (5A to 5D) from one another. The shielding plates (54, 55, and 56) will be described later.

Arrangement of Devices in Machine Chamber

A single compressor (11), a single receiver (12), and a single system electric component box (15) are disposed in each of the machine chambers (31A to 31D) of the subunits (5A to 5D). The system electric component boxes of the respective subunits (5A to 5D) accommodate electric components, such as an inverter board for driving the compressors (11) of the respective subunits (5A to 5D).

A first water heat exchanger (14*a*) is disposed in the machine chamber (31B) of the second subunit (5B). A second water heat exchanger (14*b*) is disposed in the machine chamber (31C) of the third subunit (5C). The first water heat exchanger (14*a*) is shared by the first subunit (5A) and the second subunit (5B). The second water heat exchanger (14*b*) is shared by the third subunit (5C) and the fourth subunit (5D).

An operating electric component box (16) is disposed in the machine chamber (31A) of the first subunit (5A). The operating electric component box (16) houses an electric component, such as a control board having a CPU for controlling the operation of the compressor (11) or the like. The operating electric component box (16) is shared by the four subunits (5A to 5D). A water pump (13) is disposed in the machine chamber (31D) of the fourth subunit (5D). The water pump (13) is used to circulate the heat source water between the chiller unit (1) and the fan coil unit, and is shared by the four subunits (5A to 5D).

Shape of Heat Exchanger, Arrangement of Devices in Air Passage, and Shielding Plate A single first air heat exchanger (21), a single second air heat exchanger (22), and a single fan (25) are disposed in each of the air passages (32A to 32D) of the respective subunits (5A to 5D).

Figure 6:
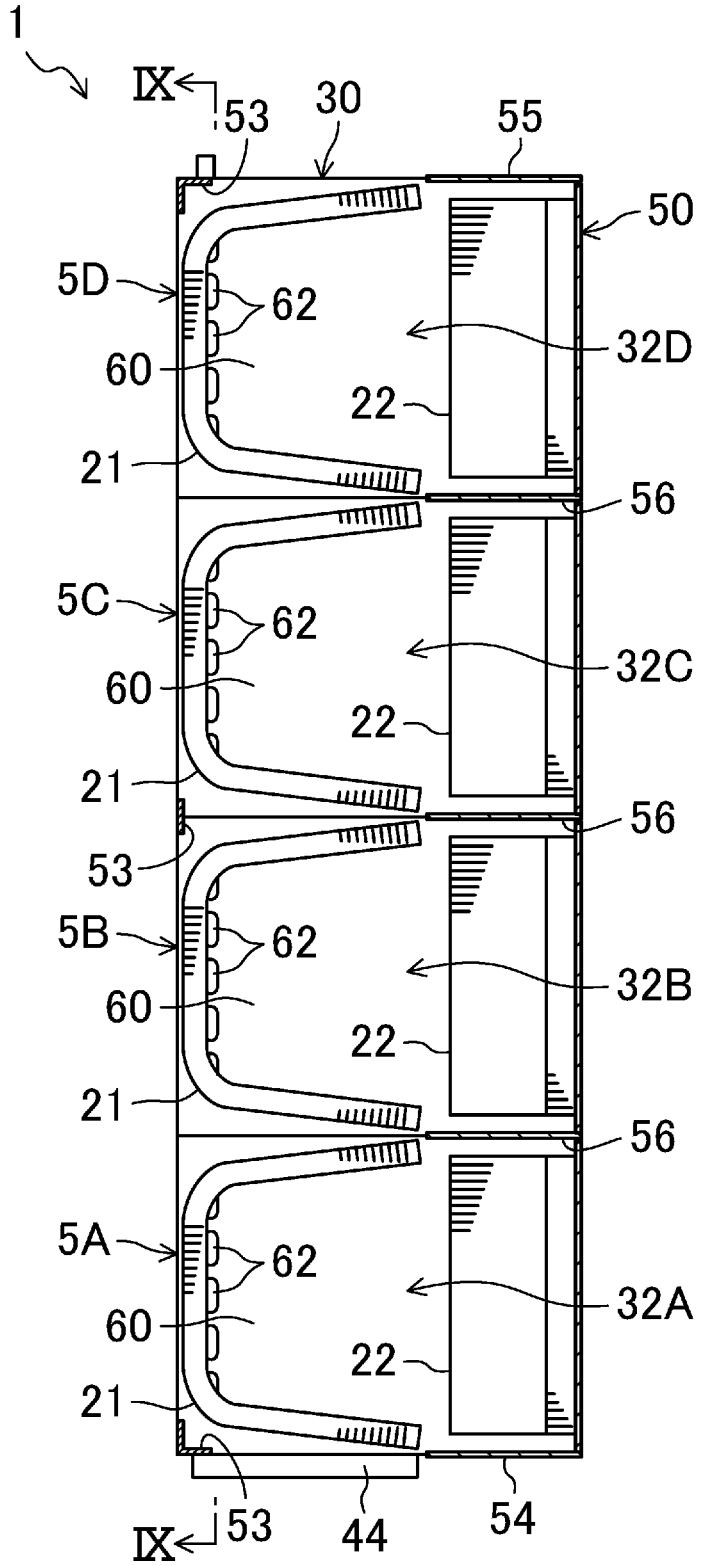
FIG. 6 is a diagram generally illustrating a cross-sectional view of the chiller unit taken along the line VI-VI in FIG. 3.

Each of the first air heat exchanger (21) and the second air heat exchanger (22) is a so-called cross-fin type fin-and-tube heat exchanger, and exchanges heat between a refrigerant and air. As shown in FIG. 6, the first air heat exchanger (21) has substantially a U shape in plan view. The first air heat exchangers (21) of the respective subunits (5A to 5D) are aligned along the left side surface of the casing (30) and in a posture that faces rightward in plan view. As shown in FIGS. 3 and 6, the second air heat exchanger (22) is in a flat plate-like shape. The second air heat exchangers (22) of the respective subunits (5A to 5D) are aligned along the right side surface of the casing (30) and in an inclined posture in which an upper end portion thereof is positioned more to the right than a lower end portion thereof.

Five shielding plates (54, 55, and 56) are provided in the upper casing (50). As shown in FIG. 3, each of the shielding plates (54, 55, and 56) is a plate-shaped member having substantially an inverted trapezoidal shape, and is provided so as to close a gap between the first air heat exchanger (21) and the second air heat exchanger (22). As shown in FIG. 6, the first shielding plate (54) is disposed at the front surface of the upper casing (50), and the second shielding plate (55) is disposed at the rear surface of the upper casing (50). The intermediate shielding plates (56) are disposed one by one between the first subunit (5A) and the second subunit (5B), between the second subunit (5B) and the third subunit (5C), and between the third subunit (5C) and the fourth subunit (5D).

As shown in FIG. 3, in each of the subunits (5A to 5D), the drain pan (60) is disposed under the first air heat exchanger (21) and the second air heat exchanger (22). Specifically, the drain pan (60) is provided so as to cover the lower end portion of the first air heat exchanger (21) and the lower end portion of the second air heat exchanger (22) from below. The bottom surface of the drain pan (60) (i.e., the upper surface of the bottom plate (61)) is inclined downward toward the left.

Figure 7:
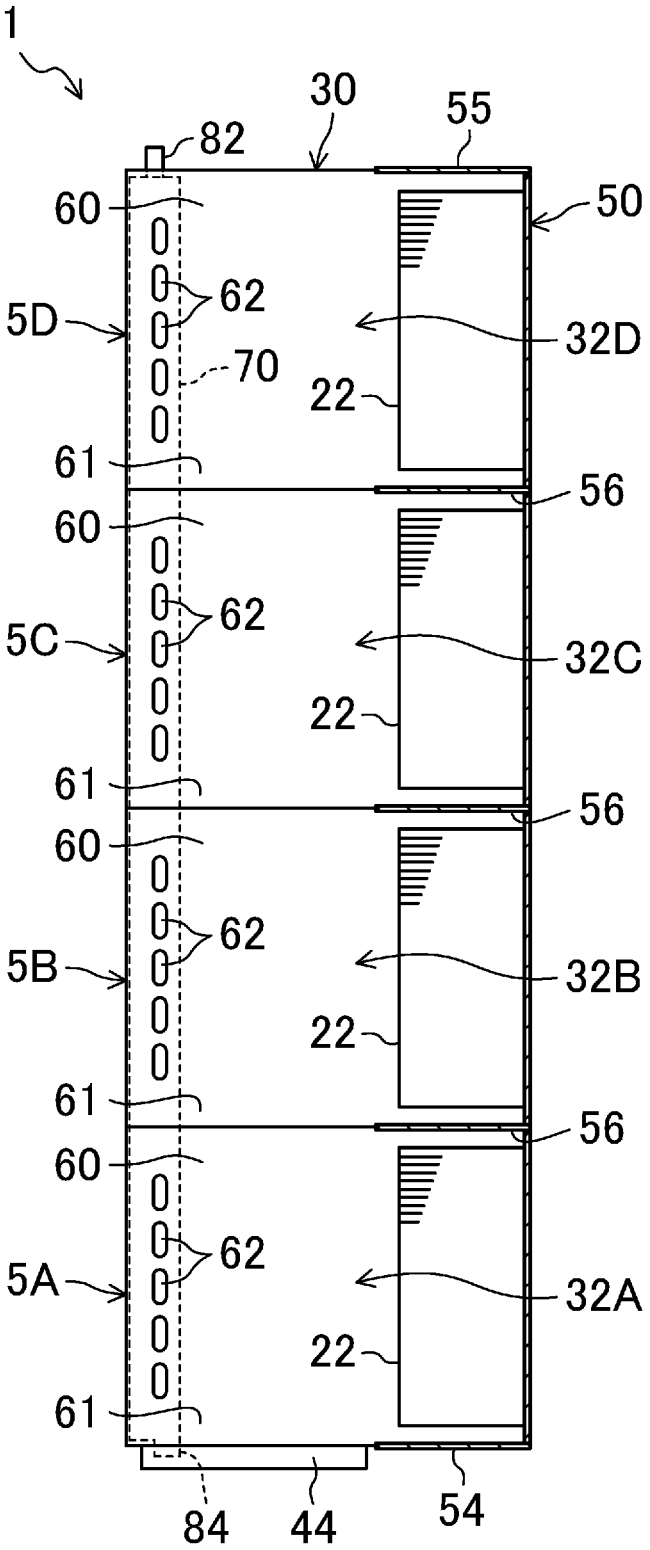
FIG. 7 is a diagram illustrating a cross-sectional view relating to FIG. 6 from which first air heat exchangers are omitted.

As shown in FIG. 7, the drain pan (60) is provided with a plurality of outflow ports (62) in a portion along the left end of the bottom plate (61). Each outflow port (62) is an oblong hole that passes through the bottom plate (61) of the drain pan (60). The plurality of outflow ports (62) are aligned along the left end of the bottom plate (61).

Drain Gutter

A drain gutter (70) is provided in the casing (30) of the chiller unit (1). The drain gutter (70) is a member which receives water flowing out of the outflow ports (62) of the drain pan (60) of each subunit (5A to 5D), and discharges the water to the outside of the casing (30).

Figure 8:
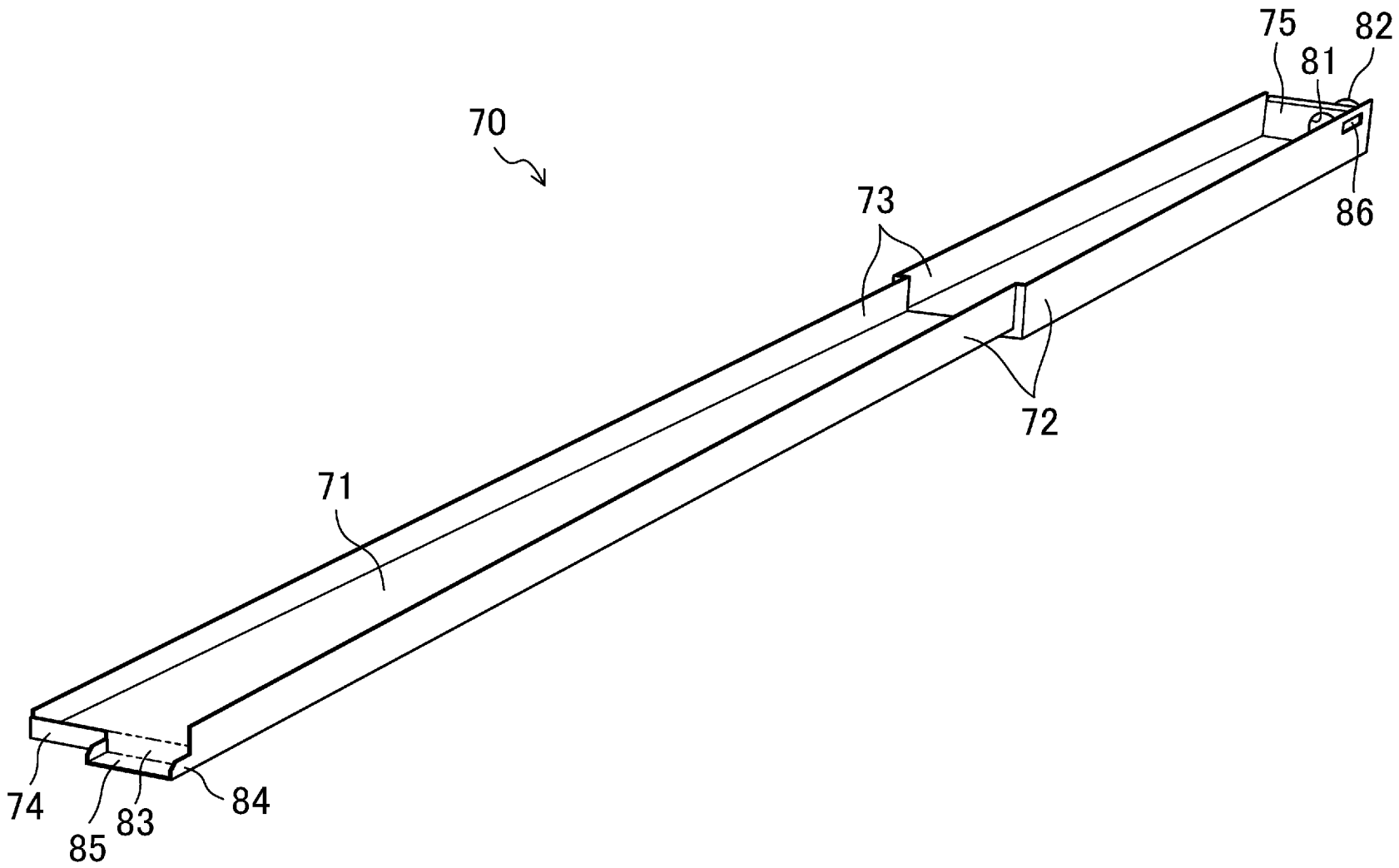
FIG. 8 is a diagram illustrating a perspective view of a drain gutter.
Figure 9:
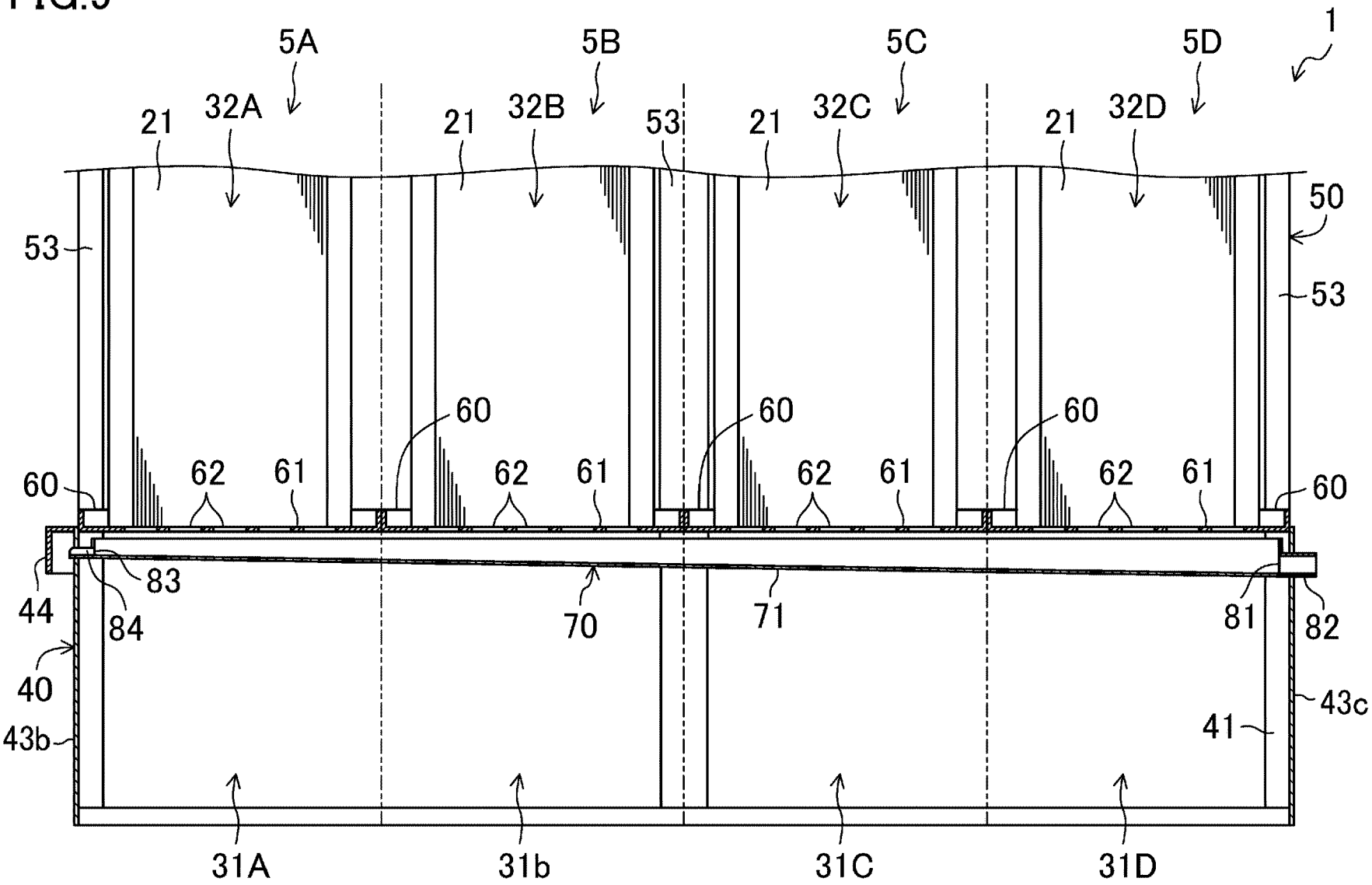
FIG. 9 is a diagram generally illustrating a cross-sectional view of the chiller unit taken along the line IX-IX in FIG. 6.
Figure 10:
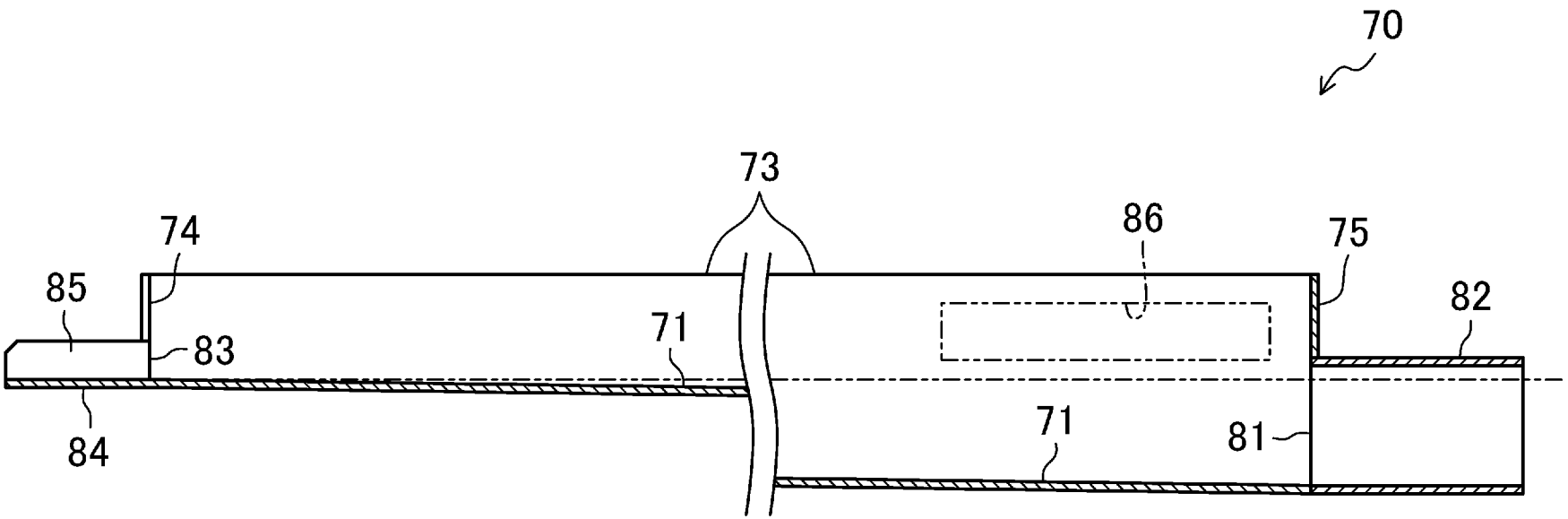
FIG. 10 is a diagram illustrating a vertical cross-sectional view of the drain gutter.

As shown in FIG. 8, the drain gutter (70) is an elongated container-like member, the upper side of which is open. The length of the drain gutter (70) is slightly shorter than the length of the casing (30) in the front-rear direction. As shown in FIGS. 9 and 10, the bottom plate (71) of the drain gutter (70) is inclined so that the depth of the drain gutter (70) gradually increases from the front end (i.e., the left end in FIGS. 9 and 10) toward the rear end (i.e., the right end in FIGS. 9 and 10). The drain gutter (70) includes a right-side panel (72) and a left-side panel (73). The upper edge of the right-side panel (72) is higher in position than the upper edge of the left-side panel (73).

As shown in FIG. 10, a rear-side panel (75) of the drain gutter (70) is provided with a main drain port (81). The main drain port (81) is a circular hole which passes through the rear-side panel (75). A hose connection part (82) for connecting a drain hose is provided at the rear-side panel (75) of the drain gutter (70). The hose connection part (82) is a cylindrical member that extends from the periphery of the main drain port (81) toward the outside of the drain gutter (70). Although not shown in the figure, a drain hose for guiding the water in the drain gutter (70) to the outside of the casing (30) is connected to the hose connection part (82).

As shown in FIG. 8, approximately a left half of the front end of the drain gutter (70) is closed by a front-side panel (74), and the remaining portion of the front end of the drain gutter (70) serves as a secondary drain port (83). The drain gutter (70) includes a guide portion (84). As is also shown in FIG. 9, the guide portion (84) is a short gutter-like portion extending from the periphery of the secondary drain port (83) toward the outside of the drain gutter (70). The guide portion (84) is continuous with the bottom plate (71), the right-side panel (72), and the front-side panel (74) of the drain gutter (70). The guide portion (84) constitutes a groove-like drain passage (85), the upper side of which is open. As shown in FIG. 10 the bottom surface of the guide portion (84) (i.e., the lowermost portion of the secondary drain port (83)) is lower in position than the uppermost portion of the main drain port (81).

As shown in FIGS. 8 and 10, an auxiliary drain port (86) is formed in the right-side panel (72) of the drain gutter (70). The auxiliary drain port (86) is a horizontally elongated rectangular through hole, and is disposed near the rear end (the right end in FIG. 10) of the right-side panel (72). The lower edge of the auxiliary drain port (86) is higher in position than the lowermost portion or the secondary drain port (83), and lower in position than the uppermost portion of the main drain port (81).

The drain gutter (70) is disposed under the drain pans (60) of the respective subunits (5A to 5D) (see FIG. 9). That is, the drain gutter (70) is disposed above the machine chambers (31A to 31D) of the subunits (5A to 5D). Further, the drain gutter (70) is disposed in the vicinity of the left side surface of the casing (30) such that the longitudinal direction of the drain gutter (70) is along the longitudinal direction of the casing (30) (see FIGS. 3 and 7). That is, the drain gutter (70) is disposed along the side surface opposite to the right side surface of the casing (30) where the maintenance opening (42) is formed. The drain gutter (70) overlaps with all outflow ports (62) formed in the drain pans (60) of the respective subunits (5A to 5D) from below (see FIG. 7).

As shown in FIG. 9, the drain gutter (70) housed in the casing (30) is arranged such that the end of the hose connection part (82) protrudes to the outside of the casing (30) through the side panel (43*c*) on the rear side of a casing (30), and that the end of the guide portion (84) protrudes to the outside of the casing (30) through the side panel (43*b*) on the front side of the casing (30).

The protruding portion of the guide portion (84) of the drain gutter (70), which protrudes to the outside through the side panel (43*b*) of the casing (30), is covered with a cover member (44) attached to the casing (30). The cover member (44) is a box-like member, the lower and rear surfaces of which are open. That is, the cover member (44) covers the upper, front, and left sides of the protruding portion of the guide portion (84). which protrudes to the outside through the side panel (43*b*) of the casing (30).

Water Draining From Drain Pan

When the first air heat exchanger (21) and the second air heat exchanger (22) function as evaporators, moisture in the air is condensed in these heat exchangers (21 and 22), and the condensed water thus generated flows down to the drain pan (60). The chiller unit (1) of the present embodiment has the blowout openings (52) formed in the upper surface of the casing (30). In rainfall, rainwater enters the air passage (32A to 32D) from the blowout opening (52) and falls into the drain pan (60). The water (such as condensed water, rainwater, etc.) which has flowed into the drain pan (60) flows along the inclined bottom plate (61) of the drain pan (60), and flows down to the drain gutter (70) through the outflow ports (62).

The water flows into the drain gutter (70) from the drain pans (60) of the respective subunits (5A to 5D). The water gathered into the drain gutter (70) from the drain pans (60) of the respective subunits (5A to 5D) flows along the inclined bottom plate (71) of the drain gutter (70) toward the rear end of the drain gutter (70). The water in the drain glitter (70) flows into the hose connection part (82) through the main drain port (81), and is drained to the outside of the casing (30) through the drain hose connected to the hose connection part (82).

A relatively large foreign substance, such as fallen leaves, may enter the air passages (32A to 32D) of the chiller unit (1). When such a relatively large foreign substance flows into the drain gutter (70) from the drain pan (60) together with water, the main drain port (81), the drain hose connected to the main drain port (81), or other portions of the drain gutter (70) may be clogged. If water cannot be drained from the main drain port (81), the water is accumulated in the drain gutter (70). In addition, when a large amount of rainwater is fallen into the air passages (32A to 32D) of the heat source unit in a short period of time due to localized heavy rain or the like, the flow rate of water flowing into the drain gutter (70) may exceed the flow rate of water flowing out of the main drain port (81) even without the clogging of the main drain port (81) and the drain hose. Water is accumulated in the drain gutter (70) in this case, as well.

As the amount of water accumulated in the drain gutter (70) increases, the water surface level in the drain gutter (70) gradually increases. The water surface level in the drain gutter (70) reaches the lowermost portion (specifically, the bottom surface of the guide portion (84)) of the secondary drain port (83) before reaching the upper edge of the left-side panel (73) of the drain gutter (70). The water in the drain gutter (70) therefore passes through the secondary drain port (83), and is guided to the outside of the casing (30) by the guide portion (84).

In this manner, according to the present embodiment, even in a situation in which a sufficient flow rate of water cannot be drained from the main drain port (81), the water in the drain gutter (70) can be drained to the outside of the machine chambers (31A to 31D) from the secondary drain port (83), which prevents the water from overflowing from the drain gutter (70). Since the water does not overflow from the drain gutter (70), the water does not enter the machine chambers (31A to 31D), and hence does not fall down to the compressors (11) nor to the electric component boxes (15 and 16).

Figure 5:
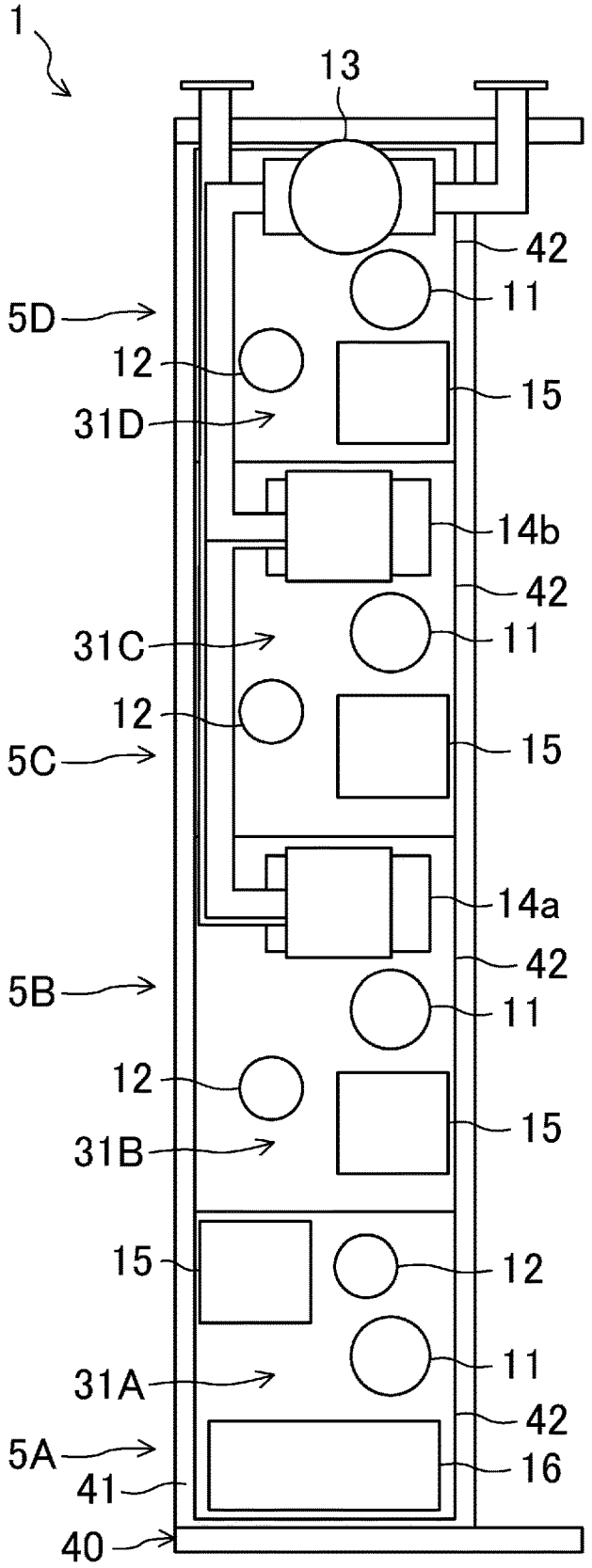
FIG. 5 is a diagram illustrating a plan view of the arrangement of main devices in machine chambers.

The water in the drain gutter (70) flows out not only from the secondary drain port (83), but also from the auxiliary drain port (86) in the situation in which a sufficient flow rate of water cannot be drained from the main drain port (81). The water that has flowed out of the auxiliary drain port (86) flows down to the machine chamber (31D) of the fourth subunit (5D). In the machine chamber (31D) of the fourth subunit (5D), the water pump (13) is provided under the auxiliary drain port (86) of the drain gutter (70) (i.e., at a position closer to the rear side of the machine chamber (31D)) (see FIG. 5). The water pump (13) provided in the chiller unit (1) of the present embodiment is configured such that the water pump (13) is capable of performing a normal operation even when the water falls onto the water pump (13). This configuration allows the chiller unit (1) to operate properly even when the water in the drain gutter (70) flows out of the auxiliary drain port (86).

Advantages of Embodiment

The present embodiment provides the drain gutter (70) which receives water flowing out from the outflow ports (62) of the drain pans (60), and the drain gutter (70) is provided with the main drain port (81) at its end portion where the depth of the drain gutter (70) is deepest, and the secondary drain port (83) at its end portion where the depth of the drain gutter (70) is shallowest. In this configuration, even in a situation in which a sufficient amount of water cannot flow out from the main drain port (81), the water in the drain gutter (70) can be drained to the outside of the machine chambers (31A to 31D) from the secondary drain port (83), which prevents the water from overflowing from the drain gutter (70). The present embodiment therefore prevents failure of the compressor (11) and the electric components housed in the electric component boxes (15 and 16) caused by the water overflowing from the drain gutter (70), which can improve the reliability of the chiller unit (1).

The drain gutter (70) of the present embodiment is configured such that the lowermost portion of the secondary drain port (83) is lower in position than the uppermost portion of the main drain port (81). Thus, water is drained from the secondary drain port (83) before the water surface in the drain gutter (70) reaches the uppermost portion of the main drain port (81). Thus, the present embodiment reliably prevents the overflow of water from the drain gutter (70).

Further, the drain gutter (70) of the present embodiment includes the drain passage (85) comprised of the guide portion (84), and the upper side of the drain passage (85) is open. Thus, even if a relatively large foreign substance enters the drain passage (85) from the drain gutter (70), the foreign substance is not caught by the guide portion (84), and is drained to the outside of the casing (30) together with water. This configuration of the present embodiment contributes to reliably draining water in the drain gutter (70) from the secondary drain port (83) to the outside of the casing (30) even if a foreign substance enters the drain passage (85). The overflow of water from the drain gutter (70) is therefore reliably avoided, which further improves the reliability of the chiller unit (1).

In the present embodiment, the cover member (44) provided for the casing (30) covers the upper, front, and lateral sides of the protruding portion of the guide portion (84) which protrudes to the outside of the casing (30). This configuration allows the water, which has flowed out from the secondary drain port (83), to be drained reliably to the outside of the casing (30) through the guide portion (84), and prevents rainwater and wind from entering the inside of the drain gutter (70) from the secondary drain port (83).

The drain gutter (70) of the present embodiment is disposed along the side surface (i.e., the left side surface) of the casing (30) which is opposite to the side surface of the casing (30) where the maintenance opening (42) is formed. Thus, the drain gutter (70) can be installed under the drain pans (60) without a decrease in workability in maintenance work for the devices (such as the compressor (11) and the electric component boxes (15 and 16)) arranged in the machine chambers (31A to 31D) and in the work of removing the devices through the maintenance opening (42).

Reference Art

Figure 11:
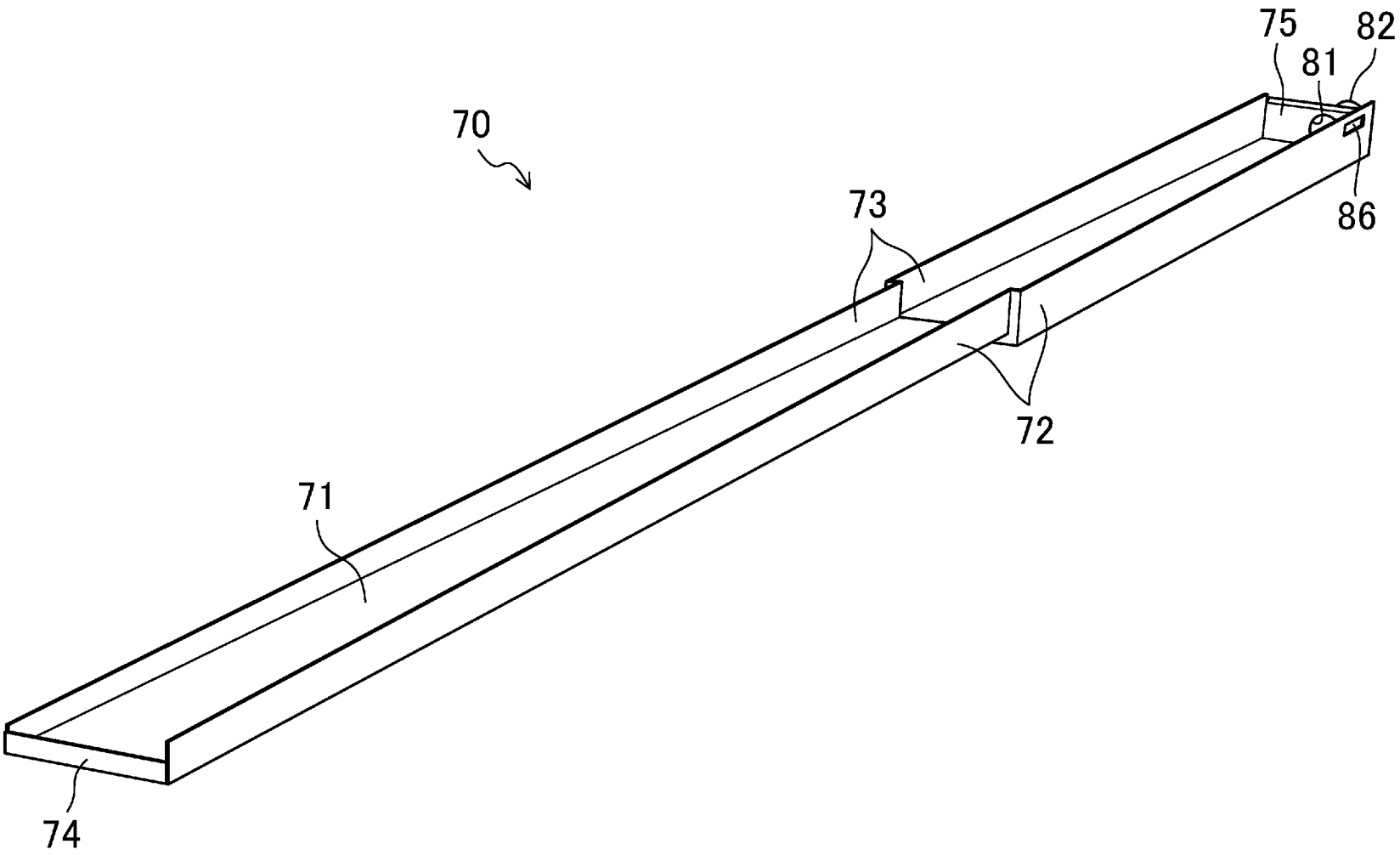
FIG. 11 is a diagram illustrating a perspective view of a drain gutter of reference art.

FIG. 11 is a diagram illustrating a drain gutter (70) of reference art. The drain gutter (70) differs from the drain gutter (70) of the embodiment shown in FIG. 8 in that the secondary drain port (83) and the guide portion (84) are omitted. Similarly to the drain gutter (70) of the embodiment, the drain gutter (70) of the reference art is disposed along the side surface (i.e., the left side surface) of the casing (30) which is opposite to the side surface of the casing (30) where the maintenance opening (42) is formed.

INDUSTRIAL APPLICABILITY

As can be seen from the foregoing description, the present invention is useful for a heat source unit for a refrigeration apparatus.

DESCRIPTION OF REFERENCE CHARACTERS

1 Chiller Unit (Heat Source Unit)
11 Compressor
15 System Electrical Component Box (Electric Component Box)
21 First Air Heat Exchanger
22 Second Air Heat Exchanger
25 Fan
30 Casing
31A, 31B, 31C, 31D Machine Chamber
32A, 32B, 32C, 32D Air Passage
42 Maintenance Opening
44 Cover Member
60 Drain Pan
61 Bottom Plate
62 Outflow Port
70 Drain Gutter
81 Main Drain Port
83 Secondary Drain Port
84 Guide Portion
85 Drain Passage

The invention claimed is:

1. A heat source unit for a refrigeration apparatus, the heat source unit comprising: a compressor; a heat exchanger which allows a refrigerant to exchange heat with air; a fan; an electric component box for housing an electric component; and a casing for housing the compressor, the heat exchanger, the fan, and the electric component box, wherein a lower portion of the casing is a closed space separated from an outside, and constitutes a machine chamber in which the compressor and the electric component box are housed, an upper portion of the casing is provided with the heat exchanger and the fan, and constitutes an air passage through which air flows, the heat source unit includes a drain pan disposed under the heat exchanger and receives condensed water generated in the heat exchanger, and a drain gutter which is disposed under an outflow port that is open in a bottom plate of the drain pan, and which receives water that has passed through the outflow port, the drain gutter has a depth which gradually increases from one end to the other end of the drain gutter, a main drain port is formed at an end portion of the drain gutter where the depth of the entire drain gutter is deepest, and the main drain port is intended to drain water in the drain gutter to an outside of the machine chamber, a secondary drain port is formed at an end portion of the drain gutter where the depth of the entire drain gutter is shallowest, the secondary drain port being intended to drain water in the drain gutter to the outside of the machine chamber, the main drain port and the secondary drain port are formed in side plates of the drain gutter, and a lowermost portion of the secondary drain port is lower in position than an uppermost portion of the main drain port.

2. A heat source unit for a refrigeration apparatus, the heat source unit comprising: a compressor; a heat exchanger which allows a refrigerant to exchange heat with air; a fan; an electric component box for housing an electric component; and a casing for housing the compressor, the heat exchanger, the fan, and the electric component box, wherein a lower portion of the casing is a closed space separated from an outside, and constitutes a machine chamber in which the compressor and the electric component box are housed, an upper portion of the casing is provided with the heat exchanger and the fan, and constitutes an air passage through which air flows, the heat source unit includes a drain pan disposed under the heat exchanger and receives condensed water generated in the heat exchanger, and a drain gutter which is disposed under an outflow port that is open in a bottom plate of the drain pan, and which receives water that has passed through the outflow port, the drain gutter has a depth which gradually increases from one end to the other end of the drain gutter, a main drain port is formed at an end portion of the drain gutter where the depth of the entire drain gutter is deepest, and the main drain port is intended to drain water in the drain gutter to an outside of the machine chamber, a secondary drain port is formed at an end portion of the drain gutter where the depth of the entire drain gutter is shallowest, the secondary drain port being intended to drain water in the drain gutter to the outside of the machine chamber the secondary drain port is formed in a side plate of the drain gutter, and the drain gutter includes a guide portion which protrudes outward from the side plate of the drain gutter and which extends from a periphery of the secondary drain port to the outside of the casing.

3. The heat source unit of claim 2, wherein the guide portion constitutes a groove-like drain passage, an upper side of which is open.

4. The heat source unit of claim 2, wherein the casing is provided with a cover member which covers upper, front, and lateral sides of a protruding portion of the guide portion which protrudes to the outside of the casing.

5. A heat source unit for a refrigeration apparatus, the heat source unit comprising: a compressor; a heat exchanger which allows a refrigerant to exchange heat with air; a fan; an electric component box for housing an electric component; and a casing for housing the compressor, the heat exchanger, the fan, and the electric component box, wherein a lower portion of the casing is a closed space separated from an outside, and constitutes a machine chamber in which the compressor and the electric component box are housed, an upper portion of the casing is provided with the heat exchanger and the fan, and constitutes an air passage which air flows, the heat source unit includes a drain pan disposed under the heat exchanger and receives condensed water generated in the heat exchanger, and a drain gutter which is disposed under an outflow port that is open in a bottom plate of the drain pan, and which receives water that has passed through the outflow port, the drain gutter has a depth which gradually increases from one end to the other end of the drain gutter, a main drain port is formed at an end portion of the drain gutter where the depth of the entire drain gutter is deepest, and the main drain port is intended to drain water in the drain gutter to an outside of the machine chamber, a secondary drain port is formed at an end portion of the drain gutter where the depth of the entire drain gutter is shallowest, the secondary drain port being intended to drain water in the drain gutter to the outside of the machine chamber a lower portion of the casing is provided with a maintenance opening capable of being opened and closed so as to take the compressor out of the machine chamber, and the drain gutter is disposed along a side surface of the casing which is opposite to a side surface of the casing where the maintenance opening is formed.

6. The heat source unit of claim 3, wherein a lower portion of the casing is provided with a maintenance opening capable of being opened and closed so as to take the compressor out of the machine chamber, and the drain gutter is disposed along a side surface of the casing which is opposite to a side surface of the casing where the maintenance opening is formed.

* * * * *